United States Patent [19]

Stoecklin

[11] 4,079,566

[45] Mar. 21, 1978

[54] METHOD OF FORMING UNITIZED MODULAR LOADS

[75] Inventor: James R. Stoecklin, Cincinnati, Ohio

[73] Assignee: The Procter & Gamble Company, Cincinnati, Ohio

[21] Appl. No.: 616,100

[22] Filed: Sep. 23, 1975

Related U.S. Application Data

[60] Division of Ser. No. 327,553, Jan. 29, 1975, abandoned, which is a continuation-in-part of Ser. No. 233,170, Mar. 9, 1972, abandoned.

[51] Int. Cl.[2] ..... B65B 11/00; B65B 13/00; B65B 35/00; B65B 61/00

[52] U.S. Cl. ..... 53/14; 53/26

[58] Field of Search ..... 53/3, 26, 27, 30 S, 53/14, 32

[56] References Cited

U.S. PATENT DOCUMENTS

| | | | |
|---|---|---|---|
| 2,709,519 | 5/1955 | Cushman | 53/26 X |
| 3,163,290 | 12/1964 | Shive | 206/526 |
| 3,388,788 | 6/1968 | Hellem | 53/30 S |
| 3,610,412 | 10/1971 | Morse et al. | 206/497 |
| 3,664,494 | 5/1972 | Mergens | 206/44 R |
| 3,804,235 | 4/1974 | Anderson | 53/30 S |
| 3,895,476 | 7/1975 | Burns | 53/30 S |

*Primary Examiner*—Robert Louis Spruill
*Attorney, Agent, or Firm*—Elliot A. Lackenbach; John V. Gorman; Richard C. Witte

[57] ABSTRACT

A pallet sized unitary load is formed of a plurality of full height separately and tightly bound stacks of containers. Each bound stack of containers is suitable for handling by itself, as a unit, by, for example, a two-wheeled hand-truck. The bound stacks are tightly strapped or wrapped and bound together to form a stable pallet sized load. Each bound stack is formed of a number of layers of containers of product with groups of one or more layers preferably being grouped together in units about the size of ordinary shipping cases and placed in a tray. This allows a stack after it has been unwrapped to serve as a display unit, with product visible above, and in the case of clear trays through, the tray wall and also allows the approximately case sized tray loads to be handled separately.

4 Claims, 7 Drawing Figures

Fig. 1
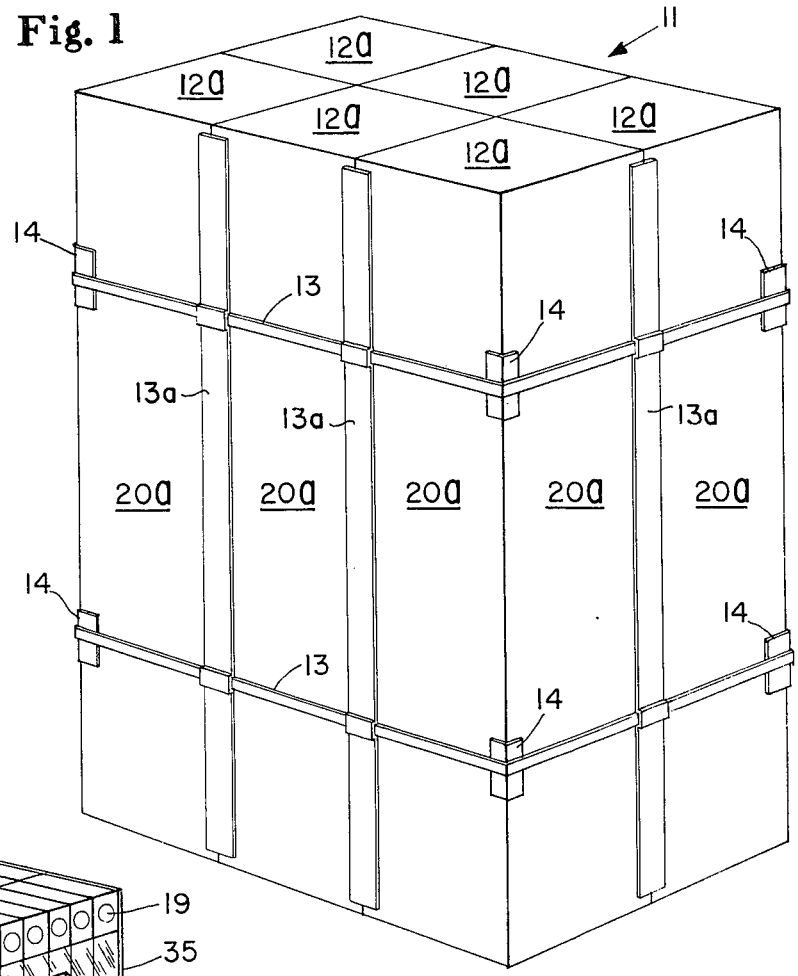
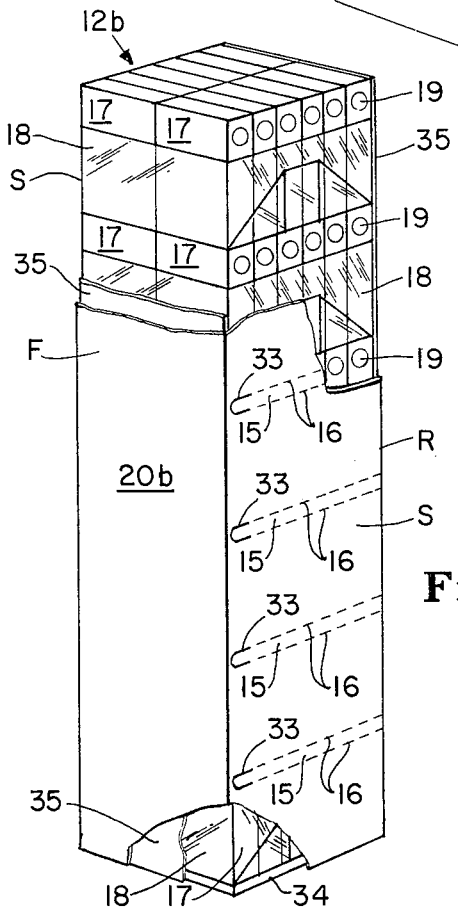
Fig. 2

METHOD OF FORMING UNITIZED MODULAR LOADS

CROSS REFERENCE TO RELATED APPLICATION

This is a division of application Ser. No. 327,553, filed Jan. 29, 1975 which in turn was a continuation-in-part of application Ser. No. 233,170 filed Mar. 9, 1972, both now abandoned.

BACKGROUND OF THE INVENTION

This invention relates to methods of forming unitized packages for multiple containers and in particular such methods of forming unitized packages to form displays.

As used herein, "containers" is a generic term used to denote the individual product-containing packages, especially those of a size and type purchased by the consumer. By way of example, "container" includes cartons, bottles, cans, rolls (e.g., of paper towels) and the like. Individual articles not requiring a separate container, but suitable for handling in the manner of a container, are also within the contemplation of the term "container" in the sense of this invention.

The term "case" as used herein indicates a package such as a corrugated box adapted to enclose a multiplicity of "containers". A "case" typically has dimensions of about 15 × 17 × 12 inches and generally has within it about 5 to about 50 containers.

Handling containers of product from the point at which they are filled and sealed by the manufacturer to the point at which they are removed from the store shelves by the consumer is a difficult and expensive process.

Most consumer products are handled through this chain of distribution today in ways much unchanged from the past. Most often containers of product are assembled into groups and put in sealed corrugated cases. The casea are often stacked on pallets which allow handling a large number of cases at a time with a fork-lift truck or the like.

This approach to packing is both expensive and time consuming. Each case of product must be a self-sufficient package to withstand all of the rigors of handling by the manufacturer, distributor, and retailer. This requires that the case be of strong, heavy material.

Each cae, except when cases are grouped on a pallet, is typically handled separately. Thus, such things are price marking and building displays usually require handling each case individually. Individual handling is obviously an expensive proposition. In additon, much of the damage to containers of product occurs as they are being handled in case sized units. A case of product seems to be right size to throw around and otherwise abuse.

There have been some advances in the art as answers to specific problems. For instance, U.S. Pat. No. 3,495,375 issued Feb. 17, 1970 to R. W. Burhop et al. shoes the overwrapping of an entire pallet load of individual cases to form a more stable unit load. U.S. Pat. No. 3,289,828 issued Dec. 6, 1966 and 3,357,553 issued Dec. 12, 1967 both to L. C. Dick et al and 3,348,673 issued Oct. 24, 1967 to G. C. BAhls et al show specialized structures for palletizing knocked-down paperboard containers. Other packages and buldles have similarly been directed to other specific problems.

Conspicuous by its absence in the prior art is a packaging structure well suited for use at each stage of the distribution process (warehousing, shipping, storing and handling at the retain level, price marking, displaying forming, etc.) for container of consumer products and the like.

OBJECTS OF THE INVENTION

It is an object of this invention to provide a method of packaging which substantially reduces or eliminates the need for individual case sized packages for handling containers of product and which results in lessened product damage.

It is another object of this invention to provide a method of forming a package intermediate a case sized package and a pallet sized load which may be handled as a unit and which allows for price marking of the contained packages and joining such a plurality of such intermediate sized packaes to enable the establishment of mass displays with a minimum amount of handling.

It is a further object to provide a general purpose of method of packaging which is suited to achieve the above objects with a large variety of different containers as previously defined.

It is still a further object of this invention to provide a method of packaging consistent with the above objects using a minimum amount of materials and therefore resulting in the smallest amount of packaging scrap to be disposed of.

SUMMARY OF THE INVENTION

In accordance with one aspect of the invention there is provided a method of forming a unitary pallet sized load comprising tightly binding a plurality of individual vertical stacks of containers bound together in abutting relationship, each of said bound vertical stacks being the full height of said unitary load, and each of said bound vertical stacks comprising a plurality of layers of individual containers and a tight overwrapping enclosing said containers.

BRIEF DESCRIPTION OF THE DRAWINGS

Although the specification concludes with claims particularly pointing out and distinctly claiming the subject matter required as forming the present invention, it is believed the invention will be better understood from the following description taken in connection with the accompanying drawings in which:

FIG. 1 is a perspective view of a pallet sized unitary load formed in accordance with the methods of this invention;

FIG. 2 is a perspective view, partially cut away, of a bound vertical stack suitable for use in the unitary load of FIG. 1;

DESCRIPTION OF THE PREFERRED EMBODIMENTS

Figure 3:
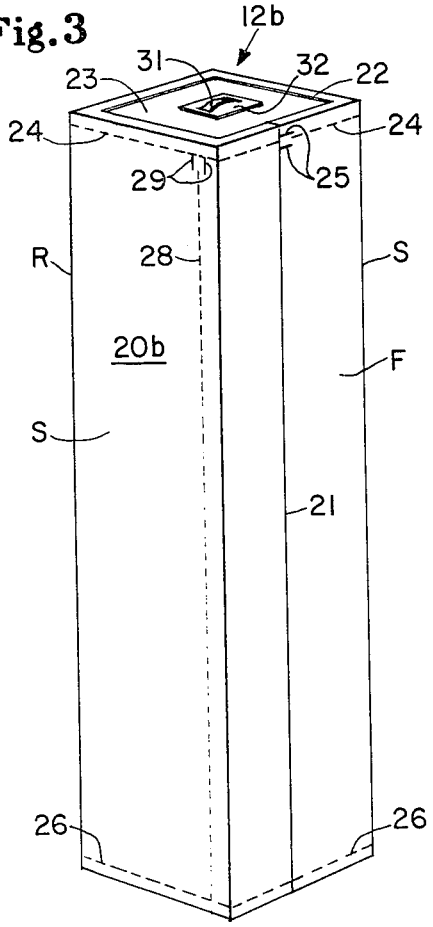
FIG. 3 is a perspective view of another configuration of the bound vertical stack showing additional construction details and the means of opening it.

Referring now to the drawings, FIG. 1 shows one embodiment of the overall unitary load formed in accordance with the methods 11 of this invention. The overall load 11 is comprised of a number of bundled vertical stacks 12*a* of containers of product. Specific features of bundled vertical stacks suitable for use in the bundled vertical stacks 12*a* are shown in FIGS. 2 to 5 and will be hereinafter described. For purposes of discussing the unitary load 11, however, it is sufficient to preliminarily characterize the bundled vertical stack 12*a* as a stack of case sized groups of containers tightly overwrapped with wrapper 20*a*.

A group of any number of the bundled vertical stacks 12*a* arranged one high in a rectangular parallelepiped is bound together to form the unitary load 11. For ease of handling and suitability for use with existing warehousing equipment the overall dimensions of the unitary load 11 are preferably those of a conventional pallet load. Although there is no single standard for the size of a pallet load the most common size is the standard adopted by the Grocery Manufacturers Association (GMA) which is 40 inches by 48 inches on the base. The height of the unitary pallet load can be varied to best utilize the space in railway cars, truck trailers, etc., but may range from about 3 to about 7 feet and is most commonly about 5 to about 6 feet.

A conventional pallet may be used to support and handle the unitary load 11; however, the use of clamp trucks which grasp a load by its sides has eliminated the requirement for pallets and this invention is preferably practiced without pallets when clamp lift trucks are available both for simplicity and for handling reasons which will be described later.

A method of binding the bundled vertical stacks 12*a* to form the unitary load 11 is the use of straps 13. The straps 13 may be of any of the materials commonly used for strapping but the use of an essentially non-extensible plastic, such as nylon which is available as strapping material from Signode Corporation of Chicago, Illinois, under the Trademark "Dymax", is preferred. Such plastics may be cut with a knife or scissors which are more readily available than the tools which are required to cut steel strapping. Such materials can provide further benefits inasmuch as a seal may be readily formed in lapped joints, producing a joint having high shear strength and low peel strength and thereby allowing strap removal by peeling with the hands, requiring no tools. The use of plastic rather than metallic strapping also largely eliminates the hazards due to the sharpness and springiness of the latter.

Two straps 13 as shown in FIG. 1, which can be made of Dymax which is 25 mils thick and ½ inch wide, will generally perform satisfactorily in connection with consumer goods wherein each bundled vertical stack weighs from about 80 to about 300 pounds. To avoid damage to the bundled vertical stacks 12*a*, corner protectors 14, preferably 8 inch lengths of 0.015 inch thick × 2 × 2 inch galvanized steel angle, should be used to distribute the force of the strap 13. The use of relatively thin metal corner protectors rather than the more conventional thick blocks of corrugated paperboard allows handling by clamp trucks and/or horizontal stacking, as will be disclosed later, without the unwanted projections of the corrugated blocks.

Another means for additionally binding the bundled vertical stacks 11*a* into a unitary load 11 consists of spanning the joints and especially the vertical joints (as viewed in FIG. 1) with tapes 13*a* comprising a strong tape such as adhesively backed kraft paper about 3 inches wide. Such tape which is reinforced with glass fibers which are oriented at 45° with respect to the vertical joints is highly desirable since the most difficult forces encountered in handling and shipping the unitary loads are the tipping forces which act at this approximate angle. In order to make such taping effective, it is necessary to, in effect, clamp together the adjacent bundled vertical stacks 12*a* prior to applying the tapes 13*a* thereto. This essentially eliminates any "gap" between the bundled vertical stacks 12*a* and, as a consequence, largely eliminates the shear forces which would otherwise be imposed on the tapes 13*a*. One way to clamp the bundled vertical stacks 12*a* prior to taping is by a clamping mechanism, e.g., by compressing between two parallel plates. The straps 13 can then be applied and used to hold the the compressed unitary load 11 prior to the application of the tapes 13*a* to the joints thereof. Such an addition of the tapes 13*a* after strapping of the compressed unitary load 11 is surprisingly effective in eliminating all relative motion ("dominoing") between bundled vertical stacks 12*a* in the same unitary load 11.

Figure 7:
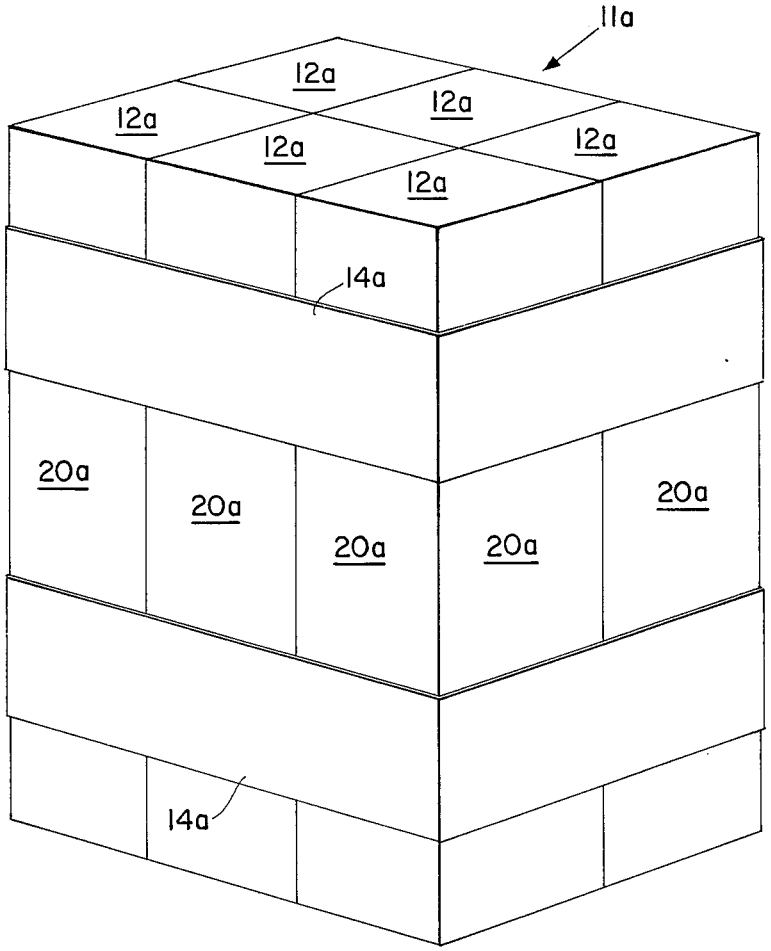
FIG. 7 is a perspective view of another pallet sized unitary load formed in accordance with this invention.

Other means can also be employed for sufficiently binding the bundled vertical stacks 12*a* to define a unitary load 11*a*. For example, and with reference now to FIG. 7, two straps 14*a* of about 12 inches width and about 7 mils thick of plastic material may be shrink wrapped about the unitary load 11. Any of the materials known in the art to be suitable for shrink wrapping may be employed.

FIGS. 2 and 3 show additional details for bundled vertical stacks 12*b*, some or all of which details can be incorporated in the bound vertical stacks 12*a*of FIG. 1 and are shown separately only for clarity and ease of description.

FIG. 2 shows bound vertical stack 12*b* with the wrapper 20*b* partially removed. Within the bound vertical stack 12*b* are a number of layers of containers 17. Preferably each layer of containers 17 is resting in a tray 18. Trays 18 allow the containers 17 to be handled in small groups corresponding to a case. The tray 18 is preferably provided with handles integral to it, as described hereinafter with reference to FIG. 5, to allow the tray 18 and its associated containers 17 to be easily lifted and moved as a single unit.

Figure 6:
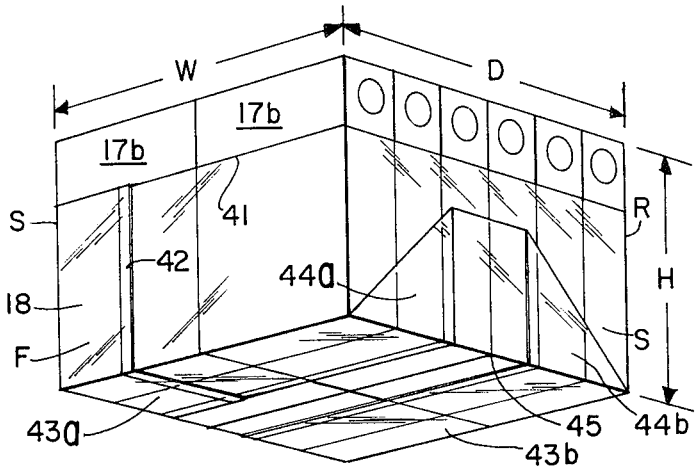
FIG. 6 is a perspective view of a tray suitable for use with this invention.

A particularly suitable tray for use with this invention is shown in FIG. 6 and designated generally as 18. The specific structural design of tray 18 forms no part of the present invention and is the subject of a separate pending U.S. Patent Application Ser. No. 238,898, filed Mar. 28, 1972, commonly owned by the assignee of this invention. The tray is formed by wrapping a sheet of polyethylene or the like about a group of containers 17*b*, arranged in a parallelepiped as shown, with the upper edge 41 of the sheet at about three-fourths of the way from the bottom to the top of the containers 17*b*. The sheet is then sealed into a tube-like form, with little or no circumferential tension, at seam 42 which may be formed by heat sealing or by any other method known to be suitable for the material being used. The sheet of polyethylene is sized such that the dimension along the seam 42 is equal to about three-fourths the height H of the containers 17*b* plus somewhat less than one-half the depth D of the parallelepiped of containers 17*b*. The polyethylene not abutting the sides of the parallelepiped of containers 17*b* is folded under from the front F and rear R thus forming a two piece bottom consisting of underlying sections 43*a* and 43*b*. Preferably sections 43*a* and 43*b* underlie at least a portion of each of the containers 17*b*. The remaining polyethylene is folded upwardly against the sides S of the parallelepiped of containers 17*b*. Regions 44*a* and 44*b* (and corresponding regions on the other side, not shown) consisting of three layers of polyethylene are heat sealed together thereby completing the formation of the tray 18. In use, the tray 18 and its contents are lifted by gripping the tray centrally of edge 45 which serves as a handle. This gathers the polyethylene material upwardly and imparts circumferential tension to the portion of the tray 18 encircling the containers 17*b*, thus locking the containers 17*b* together into a rigid block, facilitating handling.

Although the tray 18 as described above is the preferred structure for practicing this invention, "tray" in the sense of this invention is any structure permitting the handling of one or more layers of containers as a single unit. Thus, a more or less conventional tray (e.g. of corrugated paper) can be used as can a corrugated case. If used, a corrugated case will preferably have holes or other means allowing access to the price marking areas 19 of the containers 17 while they are still in the case.

It should be noted, however, that the use of a corrugated paper tray or case reduces many of the benefits to be derived from this invention. Since such a tray or case is not transparent, the enclosed containers are not visible through it for display purposes (in contrast, see FIG. 4). Also such a tray or case possesses a certain amount of strength and therefore resists compression of the containers 17 by the wrapper 20*b*. The importance of this will be discussed hereinafter.

In contrast, a "case" formed from tensioned clear plastic film (such as a shrink-wrapped film) or the tray of clear plastic film described above is well suited for use with this invention, possessing neither of the above disadvantages.

Whenever practical, containers 17 should be arranged in a two wide array as shown in FIG. 2. When so arranged, each container 17 may have a price marking area 19 adjacent an exterior face of the array. The wrapper 20*b* can comprise linerboard, a term used for the paper sheet material most commonly used as the faces of corrugated board, of about 12 mils thickness or other materials known in the art to be suitable. The wrapper 20*b* is sized to be wrapped in a single layer about the vertical faces of the bound vertical stack and provide enough overlap to form a seam 21 as shown in FIG. 3. The other dimension of the wrapper 20*b* should be slightly more than the height of the stack, thus providing the material to form a seal in the region 22 by any suitable adhesive with the top piece 23 as shown in FIG. 3 and a corresponding seal with the bottom piece (not shown). The wrapper 20*b* is tightly bound and preferably has a number of tear strips 15 thereon, as shown in FIG. 2, which are located properly on the wrapper 20*b* so that they may be removed to allow access to the price marking areas 19 without destroying the structural integrity of the bound vertical stack 12*b*. Such tear strips can be formed in any suitable manner, many of which are well known in the art, and in the present example are provided by perforations 16 and cuts 33.

To provide a strong yet light base for the bound vertical stack 12*b*a base member 34 is preferably but not necessarily used. A good base member 34 may be made from a 1 inch thick sheet of small celled styrofoam having a density of about 1.8 lbs./Ft$^3$. Less expensive materials such as multiple layers of corrugated board glued together or a honeycomb structure can also be used. The base member 34 provides a measure of protection for the lower edges and corners of the bound vertical stack 12*b*, especially when it is tipped for handling on hand trucks as will be described later.

A protective sheet 35, which can comprise any material of suitable strength, e.g., of single walled corrugated board, is optionally but preferably placed against the front F and rear R faces of the bound vertical stack 12*b* before the wrapper 20*b* is applied. This improves the vertical load bearing strength of the bound vertical stack 12*b* and also serves to protect the major faces of the containers 17 which are relatively weak.

FIG. 3 shows the bound vertical stack 12*b* including a number of additional construction features. Again, it should be emphasized that all of the features shown in FIG. 3 are preferably incorporated into any bound vertical stack. In the preferred arrangement, a three piece wrapper is used. When packaging deformable containers, to allow for the tightest wrapping, the containers 17 are placed with their minor dimension vertical for wrapping. This provides the best opportunity for product to redistribute within each container 17 and minimizes the natural bulge in the container, thereby allowing the tightest, closest packing of containers 17. Optionally, the containers 17 may be vibrated to further distribute the product within them. A wrapper 20*b* is first tensioned about the stack of containers and sealed by adhesive or tape means at a seam 21. To allow the tightest tensioning and provide the strongest bound vertical stack, the wrapper 20*b* is applied so that the direction of its grain (i.e., its stronger direction) is circumferential, corresponding to the direction of greatest stress. An end piece 23 sized approximately the same as the horizontal section of the vertical stack is then placed at each end of the stack, the lower end piece on the lower surface of base member 34 (or omitted if the base member 34 is suitable for direct adhesion to the wrapper 20*c*), and held in place by axial compression while a portion 22 of the wrapper 20*b* is lapped over the end piece 23 and sealed by appropriate means, e.g. adhesive. By following this procedure, the tightest practical bound vertical stack 12*b* is formed. It has been found that, short of crushing the containers 17, the tighter the wrapper 20*c* and 23 the stronger the bound vertical stack 12*b*.

A handle 31 is preferably attached to the top of the bound vertical stack 12*b* providing an easy means to assist in handling the bound vertical stack 12*b* as will be discussed later. The handle 31 can comprise any of the commercially available types of handles, such as that shown in U.S. Pat. No. 2,722,870 issued Nov. 8, 1955 to H. W. Vogl wherein an adhesive pad 32 is employed for affixment.

FIG. 3 further shows the preferred means for opening the bound vertical stack 12*b*. A horizontal tear tape 24 is located within about ½ inch of the top of the bound vertical stack 12*b* and completely encircles it. The materials, construction and techniques for applying tear tapes are well known to those skilled in the art and therefore not described herein. A pair of cuts 25 in the wrapper 20*b* combined with a portion of seam 21 allow access to the tear tape 24. Preferably no adhesive should be applied along the seam 21 between the cuts 25. Pulling the tear tape 24 tears the sleeve wrapping 20*b* and allows removal of the top piece 23. Because less than about ½ inch of the sleeve wrapping 20*c* depends from the top piece 23 it is relatively easy to remove the top piece 23 as there is little to hold it in place.

A vertical tear tape 28 is optionally used to open the wrapper 20*b*. If used, vertical tear tape 28 is preferably located along one edge of the bound vertical stack 12*b*. Cuts 29 in cooperation with the portion of the wrapper 20*b* exposed by the use of horizontal tear tape 24 provide access to vertical tear tape 28. When the bound vertical stack 12*b* contains relatively heavy material, as in the example hereinafter set forth, vertical tear tape 28 and cuts 29 may be eliminated. To open the sleeve wrapping in this case, the protective sheet 35 is grasped at the top and pulled outwardly and downardly. This is sufficient to tear the sleeve wrapping 20*b*, and the heavy contents prevent the bound vertical stack 12*b* from tipping over in the process.

The horizontal perforations 26 are also optionally used with light goods and not required with heavier goods. In either event, the sleeve wrapping (which is now attached only along the base 34) is torn away from the bound vertical stack 12*b* using the base 34 as a cutting edge. The perforations 26 reduce the force required in this operation to prevent movement of a relatively light bound vertical stack 12*b*.

The package system of this invention possesses a number of distinct advantages over the prior art, some of which are apparent from the description of the preferred embodiment to those skilled in the art and some of which are much more subtle but are nevertheless very significant.

The most important functional advantage of the package system of this invention is the substantial reduction in handling, particularly in the retail store, which it makes possible. Centralized price marking is recognized as one important way to simplify handling of case goods. With conventional containers each case must be individually opened to price mark its contents. If a case contains two layers of containers, the top layer must be removed to allow access to the containers in the lower layer. Typically, conventional cases are stacked on a pallet and each case must be individually removed to provide access to the case below it. In marked contrast to this, the bound vertical stack 17*b*, as best illustrated by FIG. 2, allows access through the strips 15 to each container within it without the need to move any other container. Since the strips 15 are disposed only on two opposite faces of the bound vertical stack 12*b*, their removal does not materially weaken the overall structure. The bound vertical stack 12*b* may therefore be moved as a unit even after price marking. Moreover, its size allows it to be handled with a two-wheeled hand truck. The handle 31, shown in FIG. 3, provides an easy means to tip a bound vertical stack when it is to be handled on a two wheeled hand truck.

Figure 4:
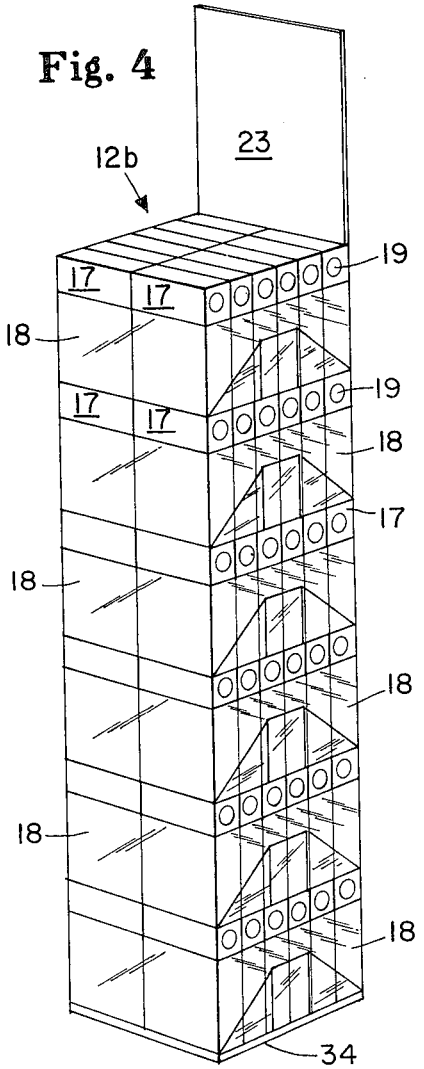
FIG. 4 is a perspective view of a typical bound vertical stack, after unwrapping, being used as a display.

The bound vertical stack 12*b* may also be used to advantage to establish a free standing floor display, as shown in FIG. 4, by moving it, before or after price marking its contents, into the desired location and removing the wrapper 20*b* and the top end piece 23 by the use of the tear tapes previously described. Since the preferred trays 18 do not materially impair viewing the faces of the containers 17 the display is complete with the unwrapping of the bound vertical stack 12*b*. Again, no handling of individual containers 17 or groups of containers 17 within a low walled tray 18 is required. The top end piece 23 may be provided with advertising copy on the face contacting the containers 17, and, when separated from the wrapper 20*b*, the top end piece may be placed above the unwrapped vertical stack as shown in FIG. 4.

Although the foregoing has emphasized the specific virtues in the bundled vertical stack 12*b* of FIG. 2 in which the array of containers 17 is two wide, it should be noted that there are many advantages to the bundling approach described herein even if the containers 17 are not of a size or type suited for two wide arrangement. Even if each low-walled tray 18 must be handled individually, the handling is still substantially reduced from that required with conventional cases which must be opened individually and from which the containers must be removed to form a display. In addition, there is obviously much less packaging material required in the bound vertical stack 12*b* including the preferred trays 18 than there would be with a corresponding number of individual cases.

The strength of both the bound vertical stack 12 and the pallet sized unitary load 11 are significantly greater than those achieved by conventional case sized units. The principal reason for this advantage is the use of a completely regular prismatic array with the packages of this invention. As can be seen in FIG. 2, each container is aligned with every other container. Because of this alignment, forces are transmitted throughout the entire unitary load 11 by the containers 17 acting as columns. This type of stacking is therefore referred to as columnar stacking. Pallet loads of conventional stacked cases cannot make advantageous use of columnar stacking because of the relative instability of a tall slender stack. This instability results in the phenomenon of "flowering", i.e., the vertical stacks spreading outwardly in all directions like the petals on a flower. Therefore pallet loads of conventional cases are placed in an "interlocking" stack which is 20 – 30% weaker than the corresponding columnar stack. The solid integral nature of the bound vertical stacks 12 coupled with the use of binding straps 13 or the like eliminate the flowering problem and allow advantageous use of columnar stacking with the package of this invention.

In connection with the above discussion of "flowering" it should be noted that the trays 18 of FIG. 2 provide a measure of lateral integrity to an unwrapped stack and are sufficient to prevent "flowering" of an unwrapped stack in the relatively gentle environment in which a display in a retail store is placed. While it is desirable to provide a tray 18 with integral handles, in some applications the provision of a sufficient number of sheets of heavy paper or paperboard interspersed among the layers of containers 17 can provide the necessary lateral integrity to avoid flowering. The use of heavy paper, or preferably corrugated board sheets interspersed can also provide additional strength in the bundled vertical stack which is important when dealing with relatively weak containers (e.g., boxes of disposable diapers) and when such a bundle is placed on its side for handling or storage. Alternatively, the containers within one or more layers may be bound together by a plastic strap or the like to eliminate "flowering". With relatively large containers in a relatively short stack, it is possible to eliminate the use of such sheets or binding altogether.

In the retail trade, the unitary load 11 is necessarily handled in the upright position as shown in FIG. 1. The strong, integral columnar nature of the unitary load 11 makes it possible to handle and store the unitary load 11 on its side in a warehouse equipped with clamp lift trucks or on its side on a suitably sized pallet. This provides several advantages, perhaps the greatest of which lies in making improved use of the direction of greatest strength of the unitary load.

Nearly all of the strength of the unitary load of this invention comes from the containers within it coupled with the tight overwrapping which makes the containers themselves more nearly rigid and from the columnar nature of the load. Unlike conventional comparatively loose fitting corrugated cases, the wrapping materials in and of themselves contribute very little to the strength of the unitary load.

The strength of the unitary load of this invention may be thought of as the sum of the strengths of the individual containers. Each container may be considered as a box column member. Using the containers of the above example for purposes of illustration, the container is a box column 3 inches deep, $8\frac{1}{4}$ inches wide and 11 inches high. The force, applied by $\frac{1}{2}$ inch/minute movement, which this container can withstand before crushing has been experimentally determined to be about 300 pounds in the direction parallel to the 3 inch dimention (i.e., on the $8\frac{1}{4} \times 11$ front and back faces), about 200 pounds parallel to the $8\frac{1}{4}$ inch dimension (i.e., on the $3 \times 11$ side faces) and 95 pounds parallel to the 11 inch dimension (i.e., on the $3 \times 8\frac{1}{4}$ top and bottom faces). This is consistent with the general principle that the strength of a column increases as the column becomes shorter, and also reflects the fact that the bottom and top are double thicknesses due to the way the container is assembled. These above forces translate into allowable forces of 475 pounds per square foot (PSF) on the $8\frac{1}{4} \times 11$ front and back, 870 PSF on the $3 \times 11$ sides, and 550 PSF on the $3 \times 8\frac{1}{4}$ top and bottom. These containers then, and indeed most common containers, are strongest from side to side.

In practice, the wrapping materials, especially the protective sheet 35 provide some additional strength. Further, the tight wrapping reduces the ability of the containers to bow outwardly further increasing their effective strength. These two factors, principally the second, add about 15% to the strength of the bound vertical stack 12*b* as compared to that predicted by considering only the strengths of the unwrapped containers 17.

Since the majority of the forces within a stack are vertically downward it is desirable to arrange the stack so that it is strongest in the direction of this force. By placing the unitary load 11 (and consequently each container 17 within it) on its side the greatest vertical vertical strength is achieved and a higher stack may be built and/or there will be less undesirable deformation of containers 17 within a given height stack. Because of the dimensions of the unitary load 11 mentioned earlier, a unitary load 11 placed on its side is also more stable, i.e., its base dimension is increased relative to its height, further facilitating tall stacks.

The strength advantage of the unitary load 11 of this invention over a conventional pallet load has been demonstrated in simulated warehousing and distribution tests. 8208 containers 17 of product as previously described were packed as described in the denominated example into 19 of the unitary loads of this invention. The unitary loads were handled with a clamp lift truck and stacked without pallets three high (3 times 66 inches or $16\frac{1}{2}$ feet of product) to simulate typical warehouse storage and held for eight weeks. The unitary loads were then shipped, placed on pallets, stacked three high with a fork lift truck, stored for 3 weeks and finally rehandled in such a way as to simulate distribution to and use by a retail store. After the test, the containers 17 were visually graded, with reference to a standardized set of photographs used for evaluating the extent of damage, with the following results: 83.3% no visible damage, 9.0% very little damage, 4.6% minor damage, 2.4% moderate damage, 0.7% severe damage.

For comparison, containers 17 in conventional cases were also stacked by clamp truck to a height of $16\frac{1}{2}$ feet and stored in the same manner as the unitary loads. Each case contained ten containers 17 arranged in a two by five array. As is customary with such case goods, the cases were placed on their sides to take advantage of the greater side to side strength of the containers 17. The cases were stacked in an interlocked pattern as is required with individual cases, 12 high. The stacks of conventional cases of containers 17 were then separated into groups identical in size to the unitary loads being tested, placed on pallets, shipped, restacked by a fork lift truck with a product height of $16\frac{1}{2}$ feet, stored for three additional weeks and rehandled in a manner identical to that used with the packages of this invention. Visual grading of statistically selected containers 17 from the cases so handled, using the same criteria used in grading the containers which had been placed in unitary loads, showed: 69.6% no visual damage; 10.4% very little damage; 12.1% minor damage; 7.1% moderate damage; and 0.8% severe damage.

Thus the containers in the unitary loads suffered less damage than those in cases notwithstanding the more advantageous orientation of containers 17 within the corrugated cases. Moreover, the majority of the severely damaged containers in the unitary load were damaged while being handled by a conventional clamp lift truck. This is significant because the strong integral nature of the unitary load of this invention makes possible two major modifications to conventional clamp trucks, both of which will result in still lower container damage. First, clamping pressures can be reduced by at least 50% from those now required to lift a pallet sized load of individual cases. Second, the camber (i.e., the lack of parallelism between the plates of the clamp truck with the plates being closer together at the bottom than at the top) of the clamp truck clamp may be climinated, thereby putting all stress more uniformly on all containers. Substantial pressure and camber is required with conventional pallet loads of individual cases to prevent the lower cases from slipping out. This requirement is obviated by the unitary nature of the load of this invention and the greater inherent parallelism of the sides of a unitary load which has been tightly overwrapped, preferably while in the horizontal position when dealing with deformable containers, to minimize individual container bulging.

The placement of the unitary loads 11 on their side also makes more efficient use of warehouse space, apart from allowing higher stacks. Particularly with the use of clamp trucks an access space is required between each stack of product. Placing the unitary load 11 on its side increases the horizontal dimension of the base, as mentioned earlier, without increasing the spacing required between stacks. Consequently the percentage of space devoted to empty space between stacks is reduced, resulting in more efficient utilization of space; i.e., a lower percentage of unused space. The reduced amount of wrapping material employed, compared to corrugated cases and the tight wrapping create a still further space savings of about 5%.

Additionally, if the product is stored on its side and placed in the upright position just prior to shipment the effects of settling of a flowable packable type product are reduced as a result of the additional handling. The additional handling, in effect, fluffs the contents which have settled in storage. This means that a container of product will appear full to the consumer just as it did when packed. This is obviously valuable as the natural settling of a flowable settleable product gives the visual, but incorrect, impression of an underfilled container.

The procedure of storing the unitary load 11 (and containers 17) on their sides during warehousing and on end in the retail handling also means that the damage from handling and the deformation from storage to the containers 17 occurs on different faces of the container 17 in the two handling and storage steps. This result is more important than it may appear at first blush. A certain amount of deformation and/or damage to each face of a container 17 may pass unnoticed while the same total deformation and/or damage concentrated on a single face may cause the container (and possibly the undamaged ones hidden by it) to be passed up for a competing brand.

Figure 5:
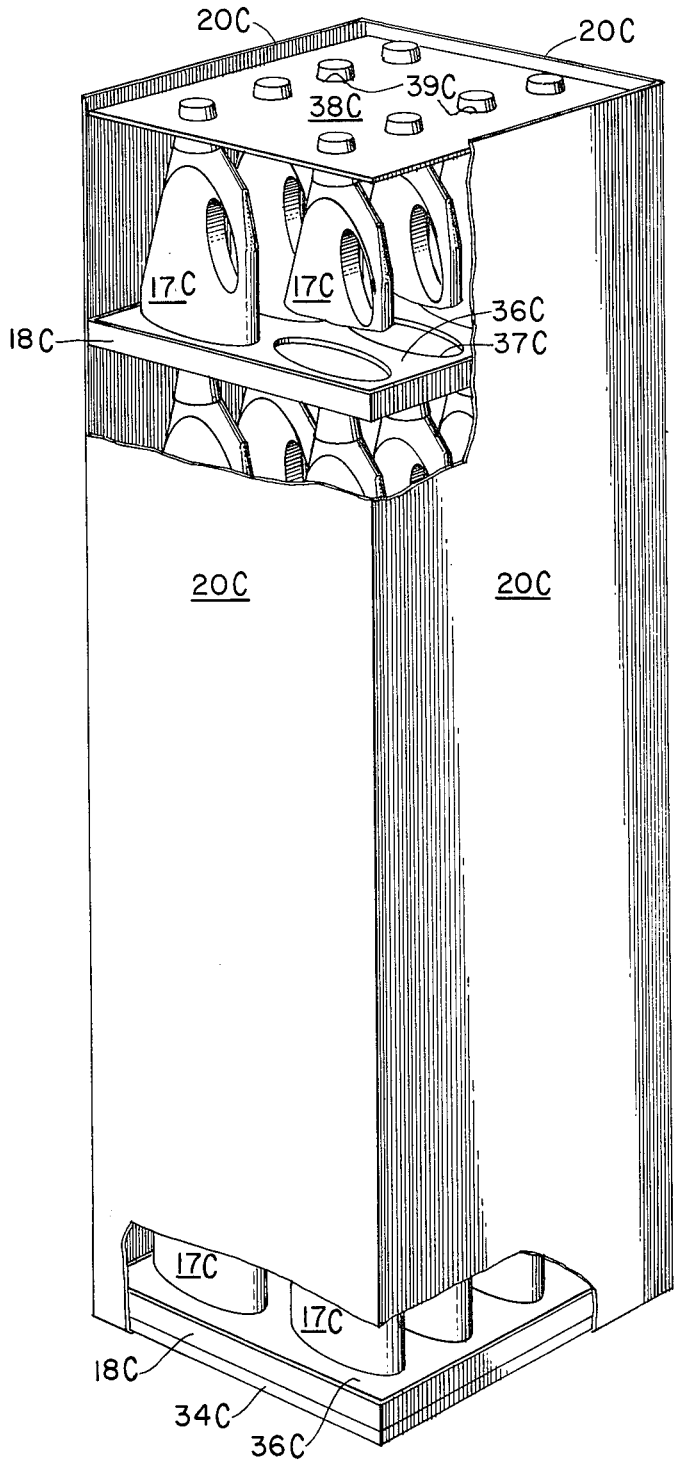
FIG. 5 is a perspective view of another bound vertical stack usable in practicing the methods of the invention.

The embodiment of FIG. 5 illustrates the use of this invention with a stack **12*c* (shown with the wrapping 20*c* partially cut away) of containers 17*c* which are rigid bottles. In this embodiment, the trays 18*c* are preferably corrugated board with sufficient strength to permit handling a layer of containers 17*c* as a unit. To hold containers 17*c* in the desired arrangement, a tray liner 36*c* with holes 37*c* adapted to engage the bottom of the containers 17*c* is provided. A locating sheet 38*c* of corrugated board or the like with holes 39*c* is optionally used to hold the top of the containers 17*c* in alignment. Such a sheet can be associated with any and all layers of containers, but is illustrated on the top layer only, for clarity. The tray liner 36*c* and locating sheet 38*c* can be replaced with an "egg-crate" type vertical divider which provides a separate compartment for each container 17*c***.

A cap member (not shown) is added to provide a planar surface for overwrapping. In addition, a protective sheet **35*c* of corrugated board or the like can be added to two or more of the 4 vertical faces of the stack 12*c* before applying the wrapping 20*c*. The protective sheets 35*c* if used provide a firm planar surface over which to place the wrapper, provide additional rigidity to the stack 12*c* and serve to distribute tension forces within the wrapper along the entire vertical edges of the stack. Although not required, the protective sheets 35*c* distribute tension in the wrapper material 20*c* which is otherwise concentrated in the areas overlying the trays 18*c* (and particularly at the corners thereof) causing the trays to have some tendency to puncture the wrapper. Rounded or mitered corners can be used on the trays 18*c* to somewhat delocalize the stress if desired. Alternatively, stress distribution can be achieved with angle members disposed along each vertical edge of the stack 12*c***. Such angle members would distribute the tension force, but not protect the overwrap from puncture over its full area.

Stacks of rigid articles such as the containers **17*c* are preferably wrapped while vertical, in contrast to stacks of cartons such as the stack 12*b*, since neither debulging nor separate application of axial pressure (apart from that imparted by the weight of the containers) is typically required with containers 17*c*. In this connection, it should be noted that, although a tight overwrap is important with such articles, that it is principally axial, as opposed to circumferential tension which is important. Accordingly, one satisfactory way to achieve the desired tension with bundled vertical stacks of glass containers or the like is with a preformed sleeve which slips snugly over a stack of trays of containers and is tightly sealed on the ends to achieve axial tension. In such an embodiment, care should be taken to adequately compress the stack axially so that the springiness is removed from the trays 18*c*** to avoid their subsequent compression which would result in a loss of tension in the bundled vertical stack.

In still another variation, individual sleeve-like members of corrugated board can be provided at each layer, i.e., associated with each of the trays **18*c* of FIG. 5. Such a member can be slipped within the vertical walls of the tray 18*c* or be a separably (e.g., by means of perforations or a tear tape) connected vertical extension of the vertical walls of the tray 18*c***.

All of the advantages associated with the embodiment of FIGS. 1 through 4 utilizing containers which are rectangular parallelepipeds (except the high three dimensional strength due to the columnar stacking) are also available with the embodiment of FIG. 5. For instance, the stack **12*c* can be handled as an integral unit while still in the overwrap. Once unwrapped the stack 12*c* is prebuilt display and each of the trays 18*c* of containers 17*c* can be handled in the manner of the trays 18 of containers 17** described above.

It can also be appreciated that many other modifications can be made to this invention to make it suitable for any of the wide variety of "containers" hereinbefore enumerated. It is not intended to limit the invention to the particular structures described, all reasonable equivalents thereof being intended to fall within the scope of this invention.

What is claimed is:

1. Method of modular packaging of a multiplicity of individual retail consumer size containers for distribution, storage, transport and retail sales display without requiring individual handling of any of the containers prior to retail sale and enabling unitized and mechanical handling thereof at all points from manufacture to retail display comprising, at least the steps of:

grouping such containers into aligned three dimensional generally rectangular cellular arrays of case load size, tightly binding each of said case load size cellular arrays into identically sized sub-modules of rectangular parallelepiped configuration so that said case load size bound groups can be manually handled and stacked;

stacking said sub-modules into hand truck load sized aligned elongated stacks to extend the cellular array in a first direction to unit hand truck load size with the individual containers being stacked in vertical alignment, tightly overwrapping each of said stacks into identically sized rigid elongated modules of rectangular parallelepiped configuration having a cross section equal that of the case load size bound groups so that said hand truck load sized stacks may be handled and stacked without separation, arranging said modules in a bundle with side by side aligned face to face contact to extend the cellular array bi-directionally generally perpendicular said first direction to lift truck load sized unit loads with the individual containers being aligned thereby in a continuous three dimensional rectangular array throughout the unit load to enable said load to resist stack and clamp loads through the aligned walls of the individual containers, and sufficiently tightly binding said bundled stacks into sufficiently tight face to face contact with sufficient compressive loading to develop sufficient frictional forces between the abutting overwrap of the stack modules to rigidify the unit load and preclude sliding between the stack modules and thereby preventing dominoing thereof and enable aligned stacking of such unit loads to warehouse sized arrays resistant to dominoing and flowering.

2. Method defined in claim 1 wherein said step of sufficiently tightly binding said bundled stacks comprises, at least the steps of clamping said bundled stacks together by compressing the bundled stacks between two parallel plates to essentially eliminate any gap between the bundled stacks and subsequently applying tapes to span the joints between the bundled stacks.

3. Method defined in claim 2 further comprising the additional step of strapping the bundled stacks after clamping of the bundled stacks and before taping the joints.

4. Method defined in claim 1 wherein said step of sufficiently tightly binding comprises applying at least one wide strap of material wrapped around the bundled stacks and tightening said wide strap to apply a binding force distributed over a sufficiently wide area to sufficiently compress the load to rigidify it against dominoing and the like.

* * * * *

UNITED STATES PATENT AND TRADEMARK OFFICE

CERTIFICATE OF CORRECTION

PATENT NO. : 4,079,566

DATED : March 21, 1978

INVENTOR(S) : James R. Stoecklin

It is certified that error appears in the above-identified patent and that said Letters Patent are hereby corrected as shown below:

Column 1, line 8, "1975" should read -- 1973 --.

Column 1, line 15, after "packages" insert -- adapted --.

Column 1, line 39, "casea" should read -- cases --.

Column 1, line 47, "cae" should read -- case --.

Column 1, line 48, "are" should read -- as --.

Column 1, line 51, "additon" should read -- addition --.

Column 1, line 54, after "be" insert -- the --.

Column 1, line 59, "shoes" should read -- shows --.

Column 1, line 63, "BAhls" should read -- Bahls --.

Column 1, line 65, "buldles" should read -- bundles --.

UNITED STATES PATENT AND TRADEMARK OFFICE

CERTIFICATE OF CORRECTION

PATENT NO. : 4,079,566

DATED : March 21, 1978

INVENTOR(S) : James R. Stoecklin

It is certified that error appears in the above-identified patent and that said Letters Patent are hereby corrected as shown below:

Column 2, line 2, "retain" should read -- retail --.

Column 2, line 3, "container" should read -- containers --.

Column 2, line 18, "packaes" should read -- packages --.

Column 2, line 20, after "purpose" delete "of".

Signed and Sealed this

*First* Day of *August 1978*

[SEAL]

*Attest:*

RUTH C. MASON
*Attesting Officer*

DONALD W. BANNER
*Commissioner of Patents and Trademarks*